US008225958B2

(12) United States Patent
Nielsen et al.

(10) Patent No.: US 8,225,958 B2
(45) Date of Patent: Jul. 24, 2012

(54) TAP AND LIQUID DISPENSER FOR A BAG-IN-BOX

(75) Inventors: Lau Nielsen, Horsens (DK); Erik Dige, Vorbasse (DK)

(73) Assignee: AMKA, Randers (DK)

( * ) Notice: Subject to any disclaimer, the term of this patent is extended or adjusted under 35 U.S.C. 154(b) by 749 days.

(21) Appl. No.: 12/226,110

(22) PCT Filed: Mar. 30, 2007

(86) PCT No.: PCT/DK2007/000167

§ 371 (c)(1),
(2), (4) Date: Dec. 22, 2008

(87) PCT Pub. No.: WO2007/112752

PCT Pub. Date: Oct. 11, 2007

(65) Prior Publication Data

US 2009/0159594 A1 Jun. 25, 2009

(30) Foreign Application Priority Data

Apr. 6, 2006 (EP) ..... 06007339

(51) Int. Cl.
*A47G 19/22* (2006.01)

(52) U.S. Cl. ..... 220/720; 220/281; 220/714; 383/906

(58) Field of Classification Search ..... 222/505, 222/507, 509, 541.9, 559, 525, 524; 220/720, 220/281, 812, 254.9, 714, 715; 383/906
See application file for complete search history.

(56) References Cited

U.S. PATENT DOCUMENTS

| | | | | |
|---|---|---|---|---|
| 3,206,075 | A | 9/1965 | Scholle | |
| 3,223,117 | A | 12/1965 | Curie et al. | |
| 3,252,634 | A | 5/1966 | Scholle | |
| 3,516,452 | A | 6/1970 | Scholle | |
| 4,475,670 | A | 10/1984 | Rutter | |
| 4,493,438 | A | 1/1985 | Rutter | |
| 5,111,970 | A * | 5/1992 | Rutter et al. | 222/83 |
| 5,551,600 | A * | 9/1996 | Sasaki et al. | 222/81 |
| 5,579,953 | A * | 12/1996 | Perkins | 222/1 |

(Continued)

FOREIGN PATENT DOCUMENTS

| | | |
|---|---|---|
| AU | 621387 | 6/1990 |

(Continued)

*Primary Examiner* — Mickey Yu
*Assistant Examiner* — Kareen Rush
(74) *Attorney, Agent, or Firm* — Day Pitney LLP

(57) ABSTRACT

This invention relates to a telescope tap to be used for the tapping of liquid from a bag-in-box where a bag containing the liquid and equipped with a spout is placed inside a box. The telescope tap comprises a base member which engages with the spout and with the box wall, a telescope pipe placed sliding extractable in the base member, a handle to extract the telescope pipe from inside the box, a knob for opening and closing the outlet in the telescope pipe, and a gap around a part of the telescope tap for slidably receiving the box wall when sliding the telescope tap into the box. The invention furthermore concerns a method of filling a bag-in-box with a fluid, where a bag with a spout is filled with a fluid, a telescope tap is placed in the spout thereby closing the bag, a cut is made in the box, and the bag then is slid into the box with the tap fitting the cut in the box.

11 Claims, 6 Drawing Sheets

U.S. PATENT DOCUMENTS 6,401,989 B1 * 6/2002 Grittmann ..... 222/538

FOREIGN PATENT DOCUMENTS

| | | | |
|---|---|---|---|
| DE | 299 14 981 | U1 | 12/1999 |
| EP | 0 350 243 | A1 | 1/1990 |
| GB | 1016019 | | 1/1966 |
| GB | 1 168 465 | | 10/1969 |
| GB | 2 088 837 | A | 6/1982 |
| WO | WO 81/00608 | | 3/1981 |
| WO | WO 85/03062 | | 7/1985 |

* cited by examiner

TAP AND LIQUID DISPENSER FOR A BAG-IN-BOX

FIELD OF THE INVENTION

The present invention relates to a tap and liquid dispensing unit for a bag-in-box. The invention furthermore relates to a method to fill a liquid into a bag-in-box from which the liquid is ready to be tapped in smaller amounts.

BACKGROUND

Liquids are often stored and sold in boxes or containers which facilitate a compact packing and easy handling of the liquid. By storing the fluid in a flexible bag within the box—a so-called bag-in-box—any amount of the liquid can be tapped from the container without air getting in contact with the liquid. This is advantageous for instance when tapping wine, as a consumer in this way is given the opportunity to enjoy a single glass of wine from the bag-in-box without the remainder of the wine in the container having to be used within a limited time in order to taste the best.

Usually the tap or dispenser on a bag-in-box is initially concealed within the box so that the boxes can be packed and stored as compactly as possible and so that the tap is not damaged during the handling of the boxes. When the liquid is to be dispensed the consumer has to break the cardboard box open along a perforation and find the tap structure with the fingers from within the box. The tap is then on most containers partly pulled out of the box and positioned in the cutout of the box and held somewhat in position by means of a flap from the cardboard box. However, after opening the box usually appears rather deteriorated and with a flawed look yielding an unfortunate impression of a cheap product. Also, the fastening of the tap in the opening of the box is most frequently very loose and shaky whereby the dispensing becomes more difficult, especially when the bag inside becomes only halfway full.

Different types of telescope taps for bag-in-boxes are known from the literature where the dispensing units are equipped with different types of valves for the tapping of the liquid. However, the telescope taps known in the art posses a number of different disadvantages such as taking up a considerably large amount of space within the box, not providing an easy mode of operation for the user, or consisting of a relatively large number of mechanical parts with complicated shapes thereby making the tap rather expensive to manufacture and inappropriate for a disposable product.

WO 81/00608 describes a telescope tap consisting in essence of a pipe which is to be heat sealed to the inner flexible bag in a bag-in-box. When employed, the user extracts the pipe from the box and operates the tap by deforming a membrane at the outer end of the pipe whereby a valve is opened. One large disadvantage of the construction of this telescope tap is, however, that the tap in its closed position takes up some space within the box whereby the inner bag must be squeezed somewhat together in order to still be able to fit into the box. Furthermore, when extracted, the pulling force applied to the tap is passed on to the bag which is also pulled towards the box wall resulting in an increased risk for leaks in the seal between the tap and the bag.

Another kind of telescope tap is described in EP 0350243. Here a telescope pipe can be extracted from within a house passage leading from the box wall to the bag opening. This design too, however, takes up quite some space within the box and thus the bag must be made in a special shape in order not to fold or wrinkle around the tap. Furthermore, the design comprises parts with more complicated shapes such as double pipes and annular cavities which inevitably make the manufacture more expensive. Also, the described tap is designed to fit into a hole in a cardboard box and being fixed to the box wall by pressing together two parts of the tap from each side of the wall. The bag is then filled through the tap as the final step, which, however, makes the filling process more complicated both with the risks of spilling on the box destroying its appearance and of wearing the assembly of the tap to the box.

OBJECT AND SUMMARY OF THE INVENTION

It is therefore an object of the present invention to provide a tap or dispensing unit for a bag-in-box overcoming the abovementioned problems.

According to one aspect the present invention relates to a telescope tap for tapping liquid from a bag-in-box comprising a box and a bag with a spout for containing the liquid characterized in that the telescope tap comprises:

- a base member to engage with the spout and engage with a part of a box wall thereby making a pipe opening from the outside of the box to the interior of the bag,
- a telescope pipe placed sliding extractable in said opening,
- a handle to extract the telescope pipe from inside the box,
- a knob for opening and closing an outlet in the telescope pipe, and
- a gap around a part of the telescope tap arranged for slidably receiving a part of the box wall when sliding the telescope tap into the box.

Hereby is obtained a tap which initially can be concealed within the bag-in-box with no protruding parts whereby the box can be packed and stored optimally. Further, the tap is easily extractable from within the box without first having to rip the box open, and the tap is easy to operate without the use of any tools and even with thick and clumsy fingers. This makes the tap extremely user-friendly for both elderly and/or handicapped persons. Another advantage of the present invention is that the bag by means of the tap is firmly attached to the box both prior to and during use whereby the risk of damaging the bag or any parts of the tap is minimized. Also the bag is attached in close relation to the box wall ensuring that the bag is not getting wrinkled or folded during the positioning in the box. This also gives a better operational control during tapping when the tap stays firmly in place and does not easily bend or move. The tap is also very advantageous in that it can be used on any standard bag with a standard spout without any fittings needed on the bag or spout. This again ensures that the standard machinery and apparatus for the handling and filling of the bag with a fluid can be used with no costly alterations needed. Yet a further advantage is that the telescope tap consists of very few parts with no complicated details whereby the tap gets very inexpensive to manufacture. Also, because of the gap, the tap is engaged and kept fixed to the box in a very simple way without need for adhesives or other attachment means. The tap (with or without the bag) can simply be slit or guided into a corresponding cut in the box without any cumbersome assembly of the tap onto the box. The design of the tap is also advantageous in that it can be pre-assembled and mounted in the filled bag acting as a plug. The filling can hence be performed on a standard bag with a standard spout using standard filling equipment without any changes. Furthermore, the plugging tap makes the filled bag very easy to handle in the further processing and during the mounting of the bag in a box—for instance by holding onto the spout which is not covered by the tap.

In other embodiments of the aforementioned telescope tap, the gap is at least partly formed from the base member or from a part of the spout. The first is advantageous in, by very simple means, providing a gap around a part of the tap which can be produced very inexpensively without the need of moving parts in any injection moulding form parts. By the latter embodiment is also obtained that the bag is attached to the box wall as closely as possible with only the spout between the bag and the box wall.

In an embodiment the knob on the telescope tap is a turning knob connected to the telescope pipe with threads. This yields a very simple way of operating the dispensing unit and controlling the fluid flow.

In another embodiment the turning knob as described above comprises one or more engagement means engaging with the base member when the tap is in its closed position preventing the knob from being turned. Hereby is achieved that the telescope tap can not be opened by mistake with the tap still in unextracted position and the opening not free of the box.

In an embodiment the telescope pipe comprises one or more guides engaging with the base member preventing the telescope pipe from rotating in the opening. Hereby is obtained that the telescope tap is kept in position and that, when a person is turning the knob, (s)he is not also rotating the telescope pipe but only the knob opening the tap.

In another embodiment the telescope tap according to the above further comprises one or more lip contact seals between said base member and said telescope pipe, whereby a watertight connection is ensured.

In yet a further embodiment the handle on the telescope tap according to the above is connected to said knob.

In an embodiment the telescope tap according to any of the above is made at least partly out of a plastic material, whereby is obtained a very inexpensive and light dispensing unit advantageous as a disposable product.

The invention further relates to a bag-in-box comprising a bag with a spout, a box and a telescope tap according to any of the previously mentioned embodiments. The advantages of this are as mentioned in relation to the telescope tap above.

According to another aspect, the present invention relates to a method for filling a bag-in-box with a fluid, where the method comprises the steps of:

at least partly filling a bag with a spout with a fluid, placing a telescope tap in the spout thereby closing the bag, making a cut in a box, sliding the bag into the box with the tap fitted in the cut in the box whereby the tap is extractable from the exterior of said box, and closing the box.

Additionally to the advantages mentioned previously, this method is advantageous in that only a simple cut of a shape matching the exterior part of the tap has to be made in a standard box prior to the placing of the filled bag within the box. Furthermore, it is a great advantage that the tap placed in the spout of the bag functions as a watertight plug whereby the following handling of the filled bag is simplified greatly also in comparison to other taps known in the art where the tap is assembled after having placed the bag in the box. This also leads to the advantages that the filling can be performed on the bag prior to be put in the box whereby the handling during the operation is easier, any spilling does not degrade the appearance of the final product and a standard filling plant or installation can be used with only minor or no modifications at all.

BRIEF DESCRIPTION OF THE DRAWINGS

In the following, preferred embodiments of the invention will be described referring to the figures, where.

DESCRIPTION OF PREFERRED EMBODIMENTS

Figure 1:
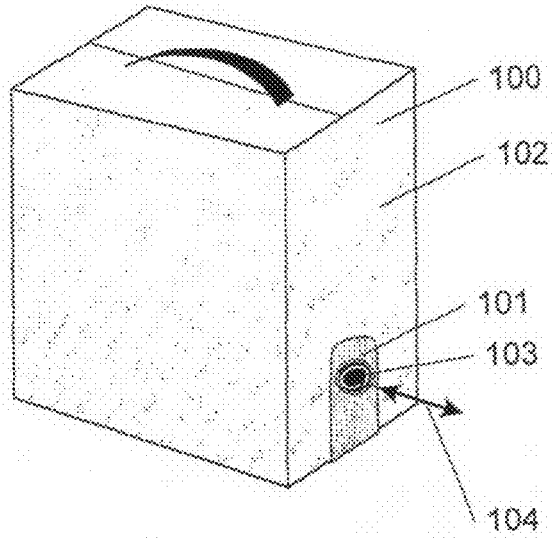
FIG. 1 shows a bag-in-box with a tap according to the invention in its closed position.

FIG. 1 shows an example of a bag-in-box 100 for storing a liquid and equipped with a tap 101 according to the invention. The liquid is preferably kept in a flexible bag within the container 102 so that the fluid can be dispensed in small amounts without air getting in contact with the remaining fluid. The box or container 102 can be made of a cardboard material, a plastic or a metal, and can have any shape preferred by the producer. One very big advantage of the tap 101 according to the invention is that it is placed in level with one of the sides of the box 102 with no protruding parts, so that the box can be packed and handled optimally without any risk of damaging any parts and still taking up a minimal amount of space. Furthermore, the tap leaves the design of the exterior of the box as undisturbed as possible with a nice finish.

Figure 2:
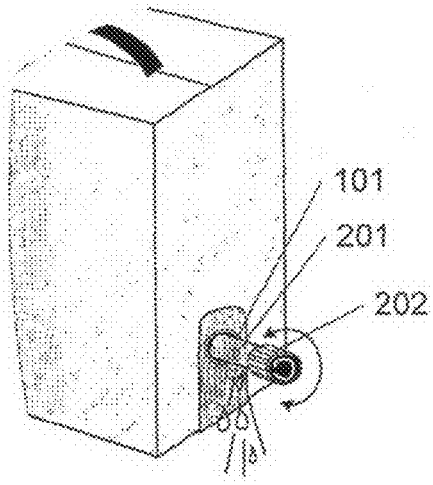
FIG. 2 shows the bag-in-box from FIG. 1 with the tap in its extracted position and open.

The tap is operated by simply pulling in a small ring or handle 103 as illustrated by the arrows 104. Hereby a telescopic pipe 201 extends as sketched in FIG. 2 and any desired amount of liquid can be dispensed by simply turning a knob 202 opening a hole in the telescopic pipe from where the liquid flows. No tools are necessary to operate the tap and the handling is very simple and uncomplicated to master also for persons with weak finger strength or elderly people. After use, the tap is closed by turning the knob back again and the tap can optionally be pushed into the box. In alternative embodiments the fluid flow is controlled by other means than the illustrated turning knob such as by different types of valves, by pushing or pulling in a handle etc.

Figure 3:
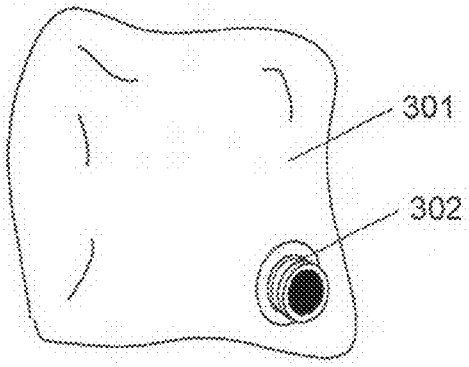
FIG. 3 illustrates a standard bag with a standard spout onto which a tap according to one embodiment of the invention can fit.

The tap according to the invention is to be mounted and used in connection with any standard bag 301 equipped with a spout 302 as sketched in FIG. 3. The spout 302 can for instance be heat sealed onto the bag 301 and is usually of some kind of cylindrical shape. The exact design, —diameter, exterior threads, thickness, material etc, —depends partly and to a large extent on the machinery used for sealing the spout to the bag, for filling the bag with a fluid and for handling the filled bag. One advantage of the present tap is that it can be used together with and fit onto any standard bag with a standard spout sealed or otherwise fixed thereon with only minor adjustments.

Figure 4:
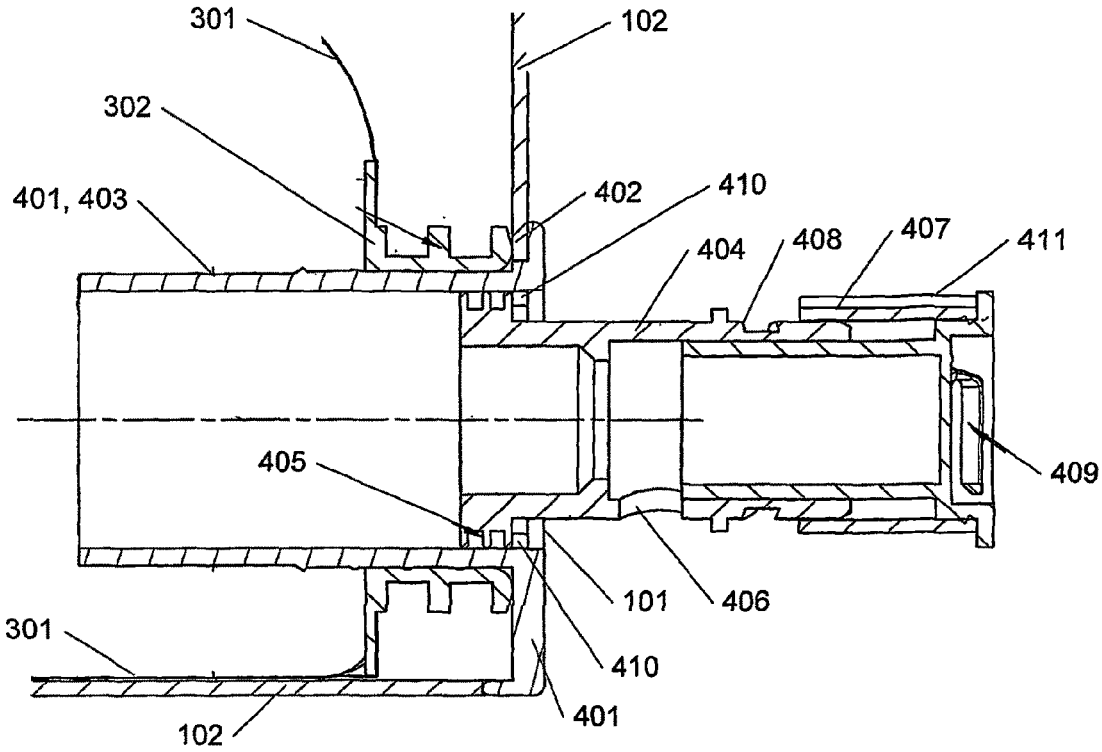
FIGS. 4-6 show one embodiment of the present invention in a cross-sectional view, from the end, and in a perspective view, respectively, with the tap extracted and open.
Figure 5:
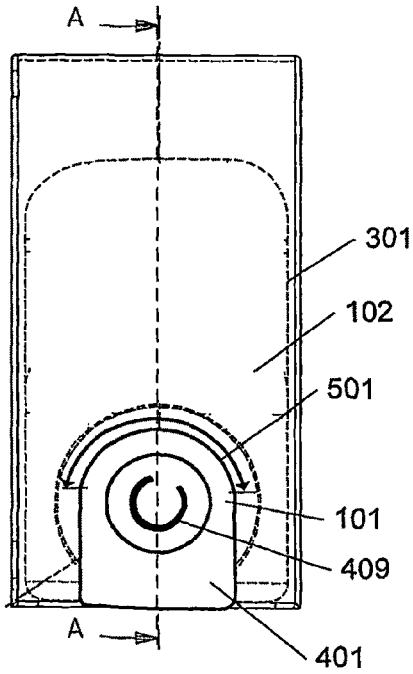
Figure 6:
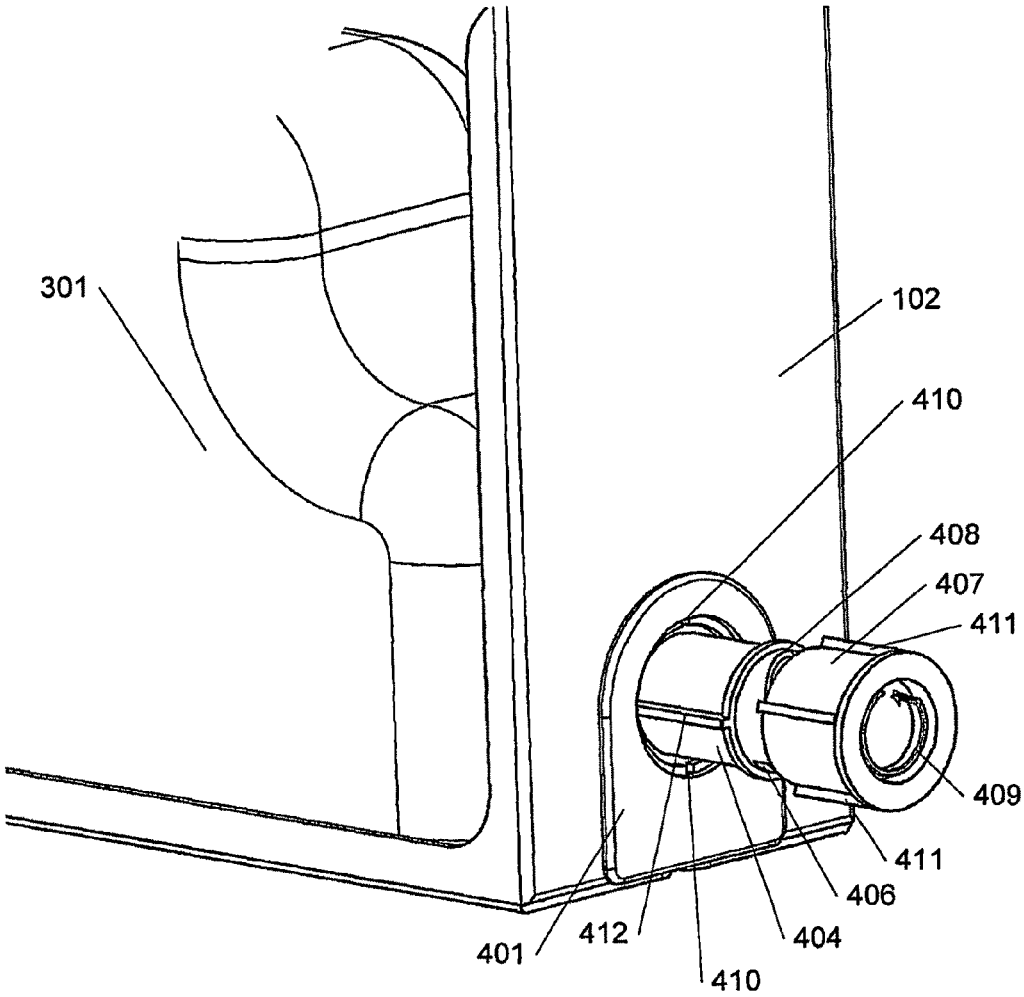

FIG. 4 shows a cross sectional and detailed view of one embodiment of the tap 101 according to the invention. In FIG. 5 the same tap is shown in an end view as mounted in a container and in FIG. 6 the tap is shown in a perspective view with most of the container and the inner bag cut away for clarity. The tap 101 is in FIGS. 4 and 6 shown in its extracted and open position. The tap is favorably positioned in the lower part of the container 102 whereby the inner bag can be emptied more or less completely without having to tilt the container. The tap 101 consists of very few parts which will be described in the following. First of all a base part 401 is shown which fits into the spout 302 on the bag 301 and engages with the spout 302 in a watertight connection forming a pipe or a channel 403 extending into the bag. The base member 401 can engage with the spout by simply clicking into recesses in the spout, by frictional forces, by heat sealing, by adhesives etc.

The spout 302 is here a short cylinder with outer annular rings or collars. The shape of the spout is determined by the apparatus and machines for handling the bag during the filling of the bag and during the handling afterwards. In relation to the tap design the spout could easily attain many other shapes, the only important part being that the base member 401 of the tap is dimensioned accordingly to fit and engage with the spout 302.

The base member 401 affixes the bag to the box by also engaging to a part of the box wall 102. Hereby the bag is kept in firm contact with the box via the telescope tap, and the tap will remain firmly attached even regardless of the amount of fluid left in the bag. In the shown embodiment the box wall fits into a gap 402 between the base part 401 and the spout 302 along the upper part 501 of the spout as shown in FIG. 5. The gap could also be molded as a part of the base part alone, as also illustrated later in FIG. 13. The shape of the base member 401 is further so that it at least covers the opening made in the box wall to leave space for the placement of the tap. Hereby the base member adds the stiffness to the box that is otherwise lost by the making of the opening in the box wall.

The tap further consists of a telescope pipe 404 placed inside the channel part 403 of the base member 401. In FIG. 4 the telescope pipe 404 is shown in its extracted position where it has been pulled out as far as possible. When the pipe is not extracted it is positioned fully within the base member and hence within the box as can be seen in the FIGS. 9 and 10. A lip contact seal 405 between the telescope pipe 404 and the base member 401 prevents any leaking of fluid. In the present embodiment of the telescope tap the fluid leaves the inner bag through the telescope pipe and out through an, outlet 406 favorably positioned in a lower part of the telescope pipe. This outlet 406 is opened and closed by turning a knob 407 positioned at the end of the telescope pipe 404 and connected hereto with threads 408 either on the exterior or the interior of the telescope pipe. At the end of the knob 407 is placed a handle 409 which is here in the shape of a small flexible ring. The telescope pipe 404 in the dispensing unit is extracted from the interior of the bag by simply pulling this handle 409. In another embodiment the handle is directly connected to the telescope pipe.

In another embodiment of the invention the knob 407 is provided with a number of protruding engaging means or guides 411 which engage with corresponding slots or grooves 410 in the base member 401 when the telescope tap is not extracted. These guides and grooves can be seen in the FIGS. 4 and 6. The guides 411 help the user to get a better grip on the knob 407 thus facilitating the tapping of the fluid but also ensure that the knob can not be turned by mistake allowing the fluid to run out when the telescope tap is still in its closed and unextracted position. The same function is in another embodiment obtained with one or more grooves in the knob engaging with corresponding pin(s) in the base member.

Figure 6A:
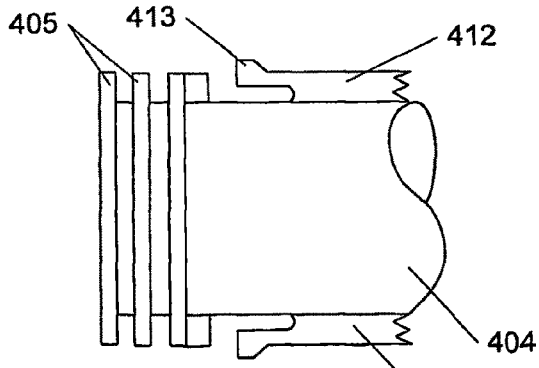
FIG. 6A shows a part of the telescope pipe with the guides visible as seen from above.

FIG. 6A shows a part of the telescope pipe 404 with the lip contact seals 405 to engage with the inner side of the base member 401 to the left. The telescope pipe 404 is here equipped with two guides 412 on its outer side which engage with grooves or cut-outs in the base member 401. Hereby the telescope pipe 404 is prevented from being able to rotate within the base member 401 ensuring that a turning force applied to the knob 407 will actually unscrew the knob and not just make the telescope pipe rotate instead. Also, the telescope pipe 404 is shaped with a number of flexible protrusions acting as snap locks 413 which, when the pipe is fully extracted, will snap over a part in the base member fixating the position of the telescope pipe and making the tap more rigid. Once fully extracted, the pipe can then not be pushed in again.

Figure 7:
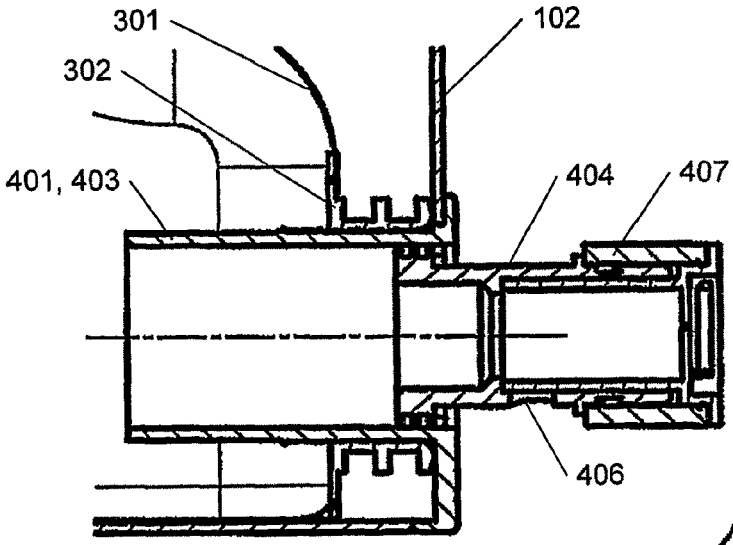
FIGS. 7-8 show the same tap as the FIGS. 4 and 6 but closed.
Figure 8:
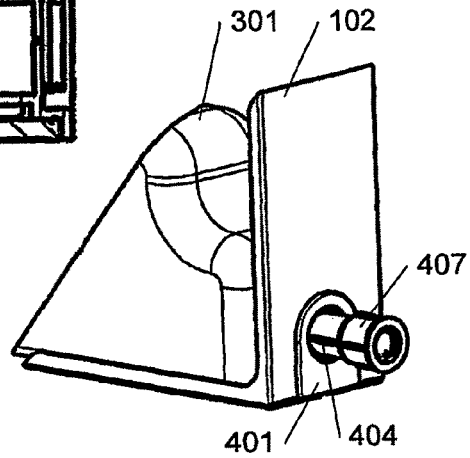

The same dispensing unit 101 as described above is also shown in the FIGS. 7 and 8. Here, the telescope pipe 404 is fully extracted (by pulling in the handle 409) as in the previous figures but the tapping opening 406 is fully sealed as the knob 407 is in its closed position.

Figure 9:
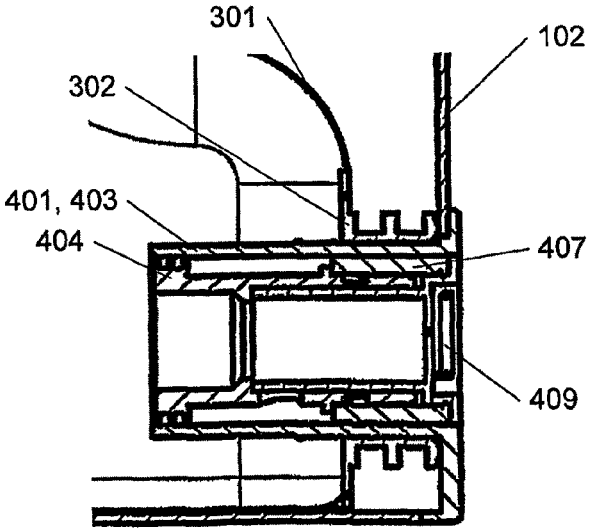
FIGS. 9-10 show the same tap as the FIGS. 4 and 6 but in its packed and closed position.
Figure 10:
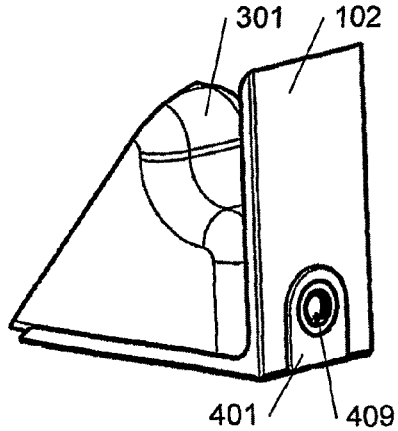

In FIG. 9 the tap is shown in the same cross-sectional view in the situation where the telescope pipe 404 has not been pulled out from within the base part 401. FIG. 10 illustrates the same in a perspective view. As can be seen from the figures, the tap according to the invention is very compact and takes up no extra space within the box and only an insignificant volume of space from within the bag. Yet still the tap does not have any parts protruding from the sides of the box and can be made so that the outer finish of the box is undisturbed by the tap both before and after having started dispensing from the container. A further important advantage of the tap is the simple way by which the telescope tap can be made ready to use by simply pulling in the handle. The dispensing unit is preferably made in a plastic yielding an inexpensive tap for single time use but could also be made completely or partly in a metal or metal alloy or a rubber material.

Figure 11:
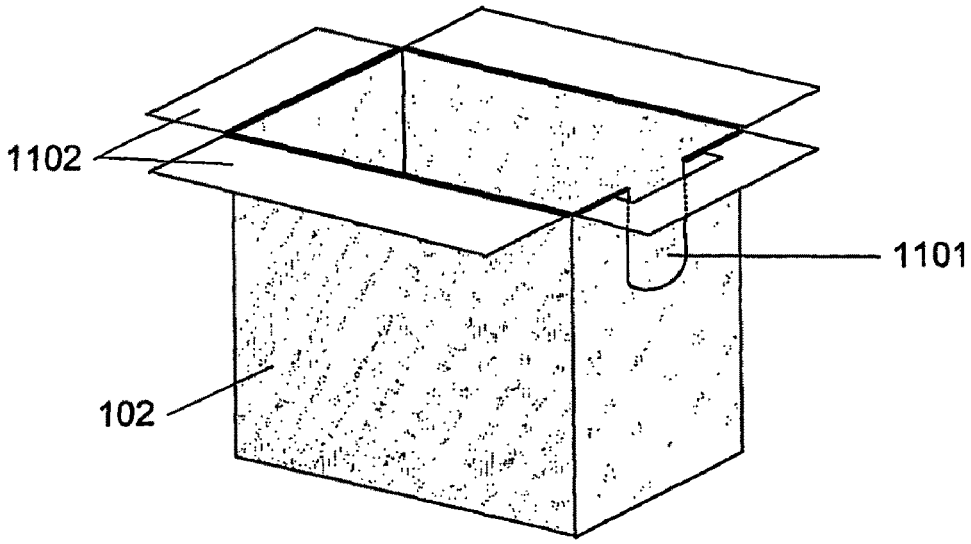
FIGS. 11-12 illustrate how an opening is made in a box in order to be packed with a filled bag with a tap according to one embodiment of the present invention.
Figure 12:
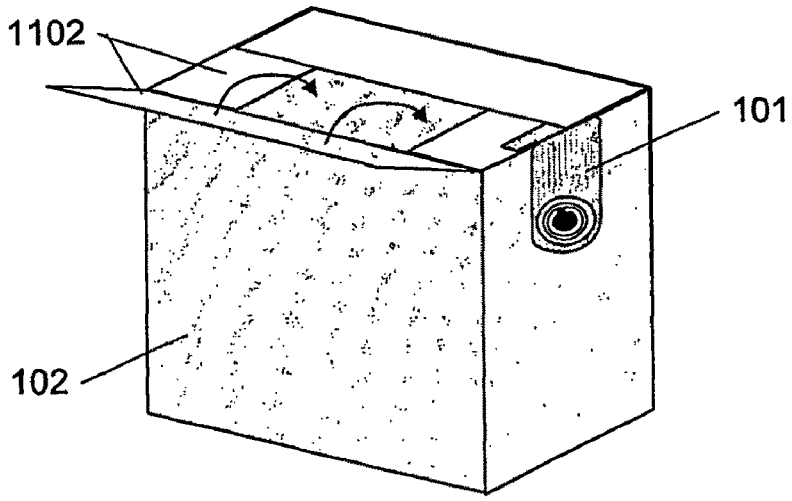

In the following FIGS. 11 and 12 is illustrated how the box in one embodiment is prepared for and equipped with a liquid filled bag with a tap according to the invention. In the figures the box is shown upside-down for clarity. When the bag with a spout has been filled with the fluid, a telescope tap 101 is put into the spout as described above and functions as a plug closing the bag completely. The box 102 into which the bag is to be placed is given a cut 1101 as sketched in FIG. 11. Hereby, the filled bag can be slid down into the box with the gap 402 on the base member on the telescope tap 101 engaging with the box wall along a part of or the whole outside edge of the tap, see FIG. 12. Then the flaps 1102 of the box are bent over and the box is closed and ready to retail. Hereby is obtained that the bag is kept in firm connection with the box via the telescope tap, regardless if the telescope tap is extracted or not.

Figure 13:
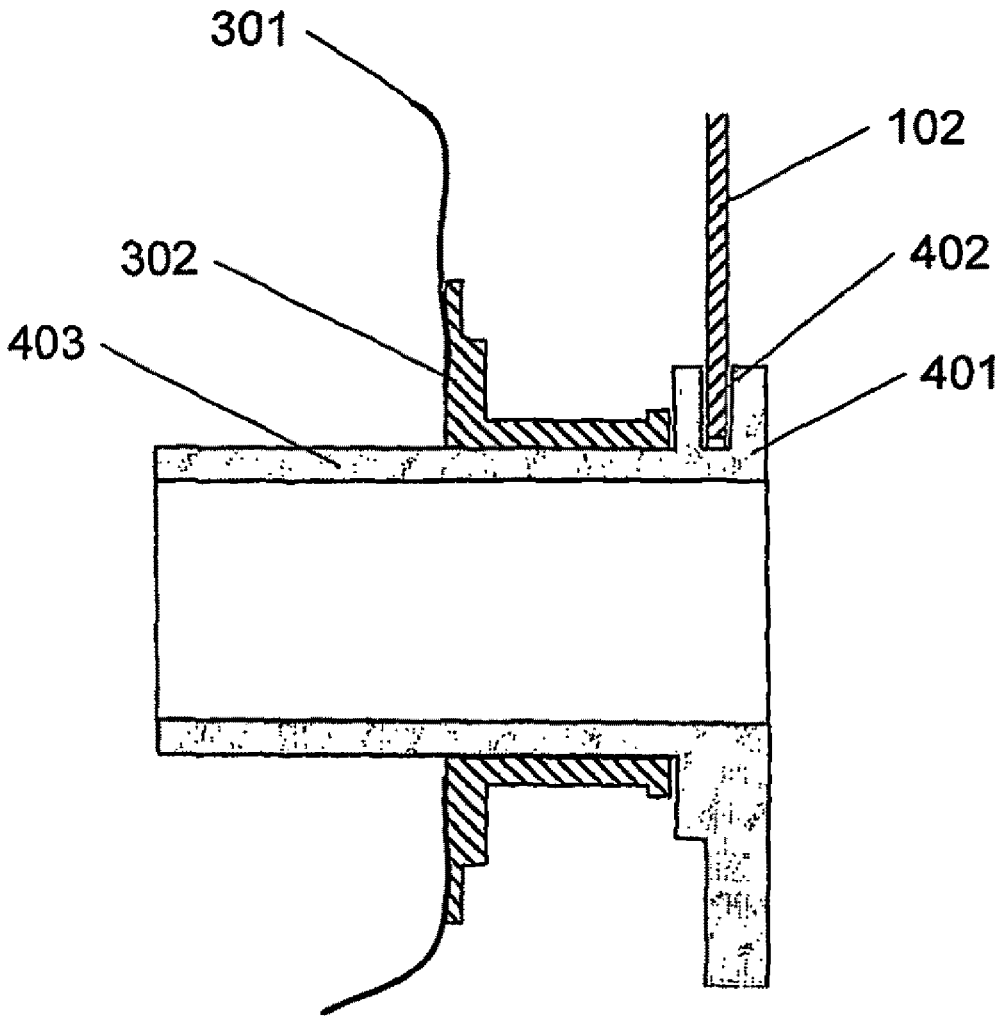
FIG. 13 shows another embodiment of a base member for a tap according to the invention.

FIG. 13 shows another embodiment of the base part 401 of the telescope tap according to the invention. Only the base part 401 placed within a bag 301 with a spout 302 and within a box 102 is shown for clarity. The base member 401 here is itself equipped with the gap 402 for engaging with a part of the box wall 102. This can be an advantage if the standard spout 302 sealed to the bag 301 for some reason is not equipped with a collar sufficiently large to make a firm connection up against the box wall.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim.

The invention claimed is:

1. A telescope tap (101) for tapping liquid from a bag-in-box (100) comprising a box (102) and a bag (301) with a spout (302) for containing the liquid characterized in that the telescope tap comprises:

a base member (401) inserted within the spout (302) to engage with a part of a box wall (102) thereby making a pipe opening (403) from the outside of the box to the interior of the hag (301), a telescope pipe (201, 404) positioned within said pipe opening for sliding movement a handle (103, 409) to extract the telescope pipe from inside the box, a knob (202, 407) for opening and closing an outlet (406) in the telescope pipe, and a gap (402) around a part (501) of the telescope tap arranged for slidably receiving a part of the box wall when the telescope tap is slid into the box.

2. A telescope tap according to claim 1, where said gap (402) is at least partly formed from said base member (401).

3. A telescope tap according to claim 1, where said gap is at least partly formed from at least a part of said spout (302).

4. A telescope tap according to claim 1, where said knob (202, 407) is a turning knob connected to said telescope pipe with threads (408).

5. A telescope tap according to claim 4, where said turning knob comprises one or more engagement means (411) engaging with said base member when the tap is in its closed position preventing the knob from being turned.

6. A telescope tap according to claim 1, where said telescope pipe comprises one or more guides (412) engaging with said base member preventing the telescope pipe from rotating in said opening.

7. A telescope tap according to claim 1, further comprising one or more lip contact seals (405) between said base member and said telescope pipe.

8. A telescope tap according to claim 1, where said handle (409) is connected to said knob (407).

9. A telescope tap according to claim 1, made at least partly out of a plastic material.

10. A bag-in-box (100) comprising a bag (301) with a spout (302), a box (102), and a telescope tap (101) according to claim 1.

11. A method for filling a bag-in-box (100) with a fluid, the method comprising the steps of:

at least partly filling a bag (301) with a spout (302) with a fluid, placing a telescope tap (101) according to claim 1, in the spout (302) thereby closing the bag (301), making a cut (1101) in a box (102), sliding the bag (301) into the box (102) with the tap (101) fitted in the cut (1101) in the box whereby the tap is extractable from the exterior of said box, closing the box (102).

* * * * *